US008747240B2

(12) United States Patent
Chen

(10) Patent No.: US 8,747,240 B2
(45) Date of Patent: Jun. 10, 2014

(54) SLINGSHOT BOUNCER

(76) Inventor: Samuel Chen, Shanghai (CN)

( * ) Notice: Subject to any disclaimer, the term of this patent is extended or adjusted under 35 U.S.C. 154(b) by 78 days.

(21) Appl. No.: 13/618,332

(22) Filed: Sep. 14, 2012

(65) Prior Publication Data

US 2014/0080616 A1 Mar. 20, 2014

(51) Int. Cl.
*A63G 13/08* (2006.01)
*A63G 23/00* (2006.01)

(52) U.S. Cl.
USPC ..... 472/95; 472/135; 124/20.1

(58) Field of Classification Search
USPC ..... 472/134, 135; 124/20.1, 20.2, 20.3; 482/27–29; 297/440.22, 183.7
See application file for complete search history.

(56) References Cited

U.S. PATENT DOCUMENTS

| | | | | |
|---|---|---|---|---|
| 2,823,483 | A * | 2/1958 | Malott | 43/19 |
| 5,501,207 | A * | 3/1996 | Black | 124/20.1 |
| 6,884,188 | B2 * | 4/2005 | Cherry | 473/451 |
| 7,452,035 | B2 * | 11/2008 | Astle et al. | 297/440.22 |
| 7,794,338 | B2 * | 9/2010 | Cherry | 473/451 |

* cited by examiner

*Primary Examiner* — Kien Nguyen
(74) *Attorney, Agent, or Firm* — Clement Cheng

(57) ABSTRACT

A slingshot bouncer has a frame. The frame is generally horizontally oriented. A rebounding bed is mounted to the frame. The frame connects to a periphery of the rebounding bed. A slingshot assembly is mounted to the frame. The slingshot assembly further includes a pouch, an elastic cord, and an upwardly extending arm. The elastic cord is mounted to the upwardly extending arm. The pouch is mounted to the elastic cord. A pouch handle is mounted to the pouch to provide grip for pulling back the pouch. The slingshot bouncer pouch handle can be formed as a loop with an opening greater than 2 cm.

6 Claims, 1 Drawing Sheet

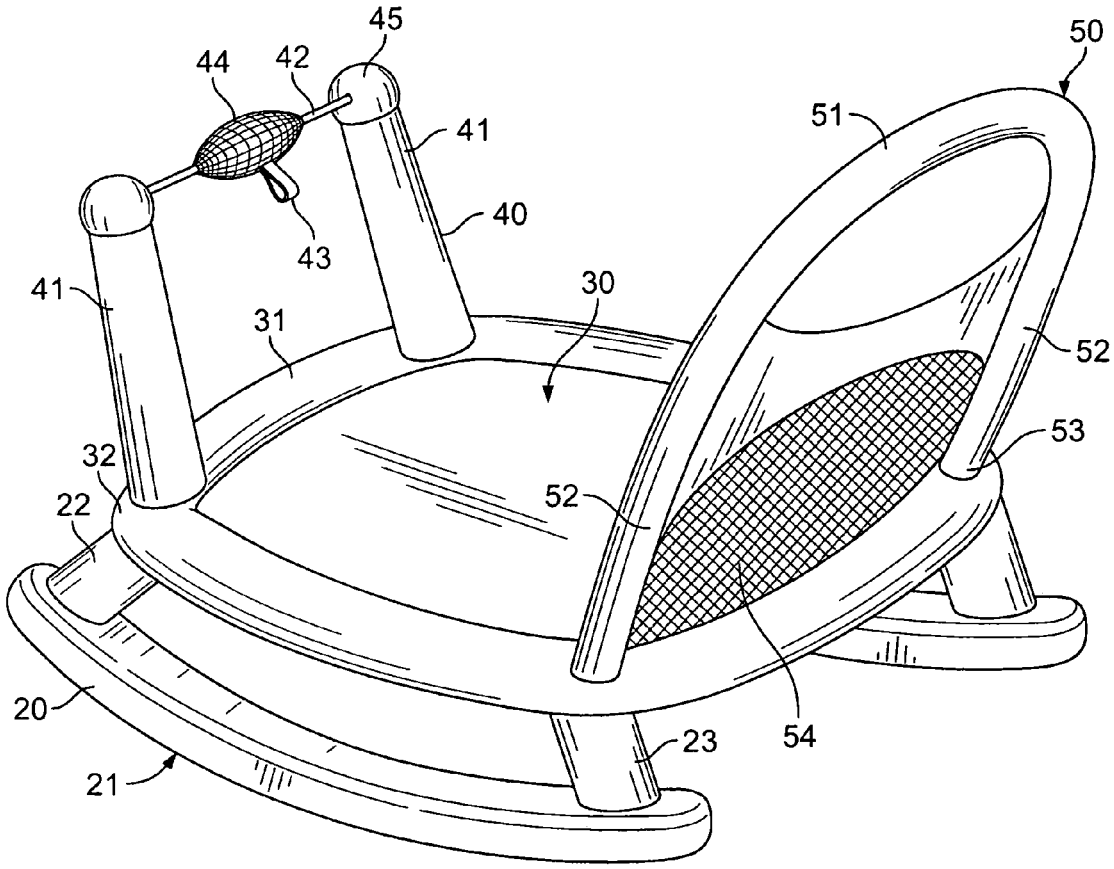
45
44
42
41
50
51
40
43
41
30
31
52
53
32
22
52
20
54
23
21

SLINGSHOT BOUNCER

FIELD OF THE INVENTION

The present invention is in the field of infant and toddler toys, namely a slingshot jumper.

DISCUSSION OF RELATED ART

A variety of different baby and toddler bouncer jumper amusement toys have been developed for small scale jumping or bouncing. Many of these are disclosed in the patent literature, such as, Child's Bounce Toy With Safety Net by inventor Semrau in U.S. Pat. No. 7,909,703 issue of Mar. 22, 2011 the disclosure of which is incorporated herein by reference. Semrau discloses a trampoline apparatus with an attached safety net for use by young children that provides them with the ability to stand on the apparatus and jump up and down on their feet.

Some of these bouncer amusement toys are inflatable. Berkey provides an inflatable child activity center in U.S. publication 2007/0123141 published May 31, 2007 entitled Inflatable Child Activity Center, the disclosure of which is incorporated herein by reference.

Harper in U.S. Pat. No. 5,575,530 issued Nov. 19, 1996 entitled Infant Bouncer, the disclosure of which is incorporated herein by reference, discloses an infant bouncer having a mode of operation with harmonic vibration regardless of weights of infants placed within the carrier. Harper suggests that rocking or rhythmic bouncing can be enjoyable and soothing to an infant or toddler.

A variety of different ornamental and structural designs for baby bouncer frame structures can be adopted. One example is the design for a Rocker Device, U.S. patent D480,884 issued Oct. 21, 2003 to Kane, the disclosure of which is incorporated by reference. Kane discloses a pair of wire loops for providing a rocking motion.

SUMMARY OF INVENTION

A slingshot bouncer has a frame. The frame is generally horizontally oriented. A rebounding bed is mounted to the frame. The frame connects to a periphery of the rebounding bed. A slingshot assembly is mounted to the frame. The slingshot assembly further includes a pouch, an elastic cord, and an upwardly extending arm. The elastic cord is mounted to the upwardly extending arm. The pouch is mounted to the elastic cord.

A pouch handle is mounted to the pouch to provide grip for pulling back the pouch. The slingshot bouncer pouch handle can be formed as a loop with an opening greater than 2 cm. The upwardly extending arm is a first slingshot arm and a second upwardly extending arm can be a second slingshot arm. The elastic cord is stretched between the first slingshot arm and the second slingshot arm.

Also, the elastic cord stretched between the first slingshot arm and the second slingshot arm can be connected at a first cord connector cap and a second cord connector cap. The elastic cord is retained between the first cord connector and the second cord connector cap.

A safety back support is formed as a handle assembly. The handle assembly further includes a pair of back rest posts. The pair of back rest posts connects together in an arch shape with an apex of the arch shape being a back rest handle. A leg extends downwardly from the frame; and a rocker is attached to the leg, whereby the rocker provides rocking motion for a user.

BRIEF DESCRIPTION OF THE DRAWINGS

FIG. 1 is a perspective view of the present invention.

The following call out list of elements is a useful reference for referencing the call out numbers of the drawings.

20 Base Support
21 Rocker
22 First Leg
23 Second Leg
30 Trampoline Bed
31 Frame
32 Leg Connection
40 Slingshot Assembly
41 Slingshot Arms
42 Elastic Cord
43 Pouch Handle
44 Pouch
45 Cord Connector Cap
50 Handle Assembly
51 Back Rest Handle
52 Back Rest Post
53 Back Rest Post Connection
54 Back Rest Net

DETAILED DESCRIPTION OF THE PREFERRED EMBODIMENT

The present invention is designed to be an indoor infant toddler amusement device. It is preferred to have an open pouch for launching of the balls. Although desirable, it is not necessary for operation of the invention to provide projectile launch of balls.

The present invention is a small size trampoline mounted to a base support 20. The base support 20 rocks forward and backward on a first and second rocker 21. Each of the first and second rocker 21 has a first leg 22 and a second leg 23. The first leg 22 and the second leg 23 are supportive of the rocker 21. The base support 20 could be made of a hard plank of wood, however though they support 20 is preferably made of a soft padded material such as foam to avoid pinching of curious fingers and toes. Similarly, the first leg 22 and the second leg 23 can be made of a plastic core wrapped in a soft material such as a foam or cloth.

The trampoline bed 30 can be formed of a mesh similar to an outdoor trampoline stretched across a frame 31. Optionally, the trampoline 30 can be mounted to the frame 31 by springs. The mesh material for the trampoline bed 30 is preferably an elastic stretchable material. When the restoring force of the trampoline bed is primarily the elasticity of the elastic stretchable material, it is preferred not to have a user greater than a small child. No frame 31 is connected to the first leg and the second leg at a leg connection 32. The leg connection can be completed with attachment hardware or without hardware such as a snap fit connection between plastic injection molded parts.

A slingshot assembly 40 may include slingshot arms 41 extending upward from the frame 31. The frame 31 is oriented in a generally horizontal plane and can be rectangular or oval in shape. The upwardly extending arms terminate at cord connector caps 45. An elastic cord 42 is stretched between the cord connector caps 45. Preferably, the cord connector caps snap into place. The cord connector caps are preferably plastic injection molded.

A pouch handle 43 can be mounted to the pouch 44. The pouch can be a net like material that can hold balls. The pouch is closable so that it has a closed configuration and an open configuration. The pouch can be in an open position as opened to place a ball within. The open pouch can be used to launch the ball when the user pulls the pouch back using the pouch handle and then releases the pouch handle with the ball in the pouch. A closed pouch allows the user to watch the balls rattle around inside the pouch. The pouch could be stitched into a permanently closed position for younger children. The balls are preferably large enough to avoid being a choking hazard to younger children. The pouch can also be made as a plastic ball or a fabric ball with the pouch handle connected to the plastic ball or fabric ball.

A safety back support can be formed as a handle assembly 50. The handle assembly 50 preferably has a back rest handle 51 that is padded for safety. The back rest handle 51 can be used by an adult to pick up the slingshot jumper. The back rest handle 51 is preferably integrally formed with a pair of back rest posts 52 that extend vertically from the frame. The back rest posts 52 are preferably connected to the frame at back rest post connections 53. The back rest net 54 extends between the back rest posts 52. The back rest net 54 may have a mesh portion and a solid portion. The solid portion may have printed graphics.

The body of a child may fit within the indented portion of the safety back support and the safety back support is preferably formed as a cradle shape with the fabric netting to retain the child within. The back rest posts 52 extend upward and have an outward angle. The first leg and the second leg have an outward angle also.

The use of the bouncer can be from a seated position or a standing position. The combined motion of the pulling on the slingshot pouch and bouncing may create a more varied oscillating motion for the young human user. Also, the motion of the rocking can be combined with the motion of the bouncing and pulling may create an even more varied oscillating motion for the young human user.

The invention claimed is:

1. A slingshot bouncer comprising:

a. a frame, wherein the frame is generally horizontally oriented;

b. a rebounding bed mounted to the frame, wherein the frame connects to a periphery of the rebounding bed;

c. a slingshot assembly mounted to the frame, wherein the slingshot assembly further includes:

i. a pouch;

ii. an elastic cord, wherein the pouch is mounted to the elastic cord;

iii. an upwardly extending arm wherein the elastic cord is mounted to the upwardly extending arm; and d. a rocker connected to the frame under the frame to provide rocking motion for a user.

2. The slingshot bouncer of claim 1, further comprising: a pouch handle mounted to the pouch to provide grip for pulling back the pouch.

3. The slingshot bouncer of claim 1, wherein a pouch handle is formed as a loop with an opening greater than 2 cm.

4. The slingshot bouncer of claim 1, wherein the upwardly extending arm is a first slingshot arm; and further comprising a second slingshot arm, wherein the elastic cord is stretched between the first slingshot arm and the second slingshot arm.

5. The slingshot bouncer of claim 1, wherein the upwardly extending arm is a first slingshot arm; and further comprising a second slingshot arm, wherein the elastic cord is stretched between the first slingshot arm and the second slingshot arm; and further comprising a first cord connector cap and a second cord connector cap wherein the elastic cord is retained between the first cord connector and the second cord connector cap.

6. The slingshot bouncer of claim 1, further comprising: a safety back support formed as a handle assembly, wherein the handle assembly further includes a pair of back rest posts, wherein the pair of back rest posts connects together in an arch shape with an apex of the arch shape being a back rest handle.

* * * * *